US012703465B1

(12) United States Patent
Surma

(10) Patent No.: US 12,703,465 B1
(45) Date of Patent: Aug. 11, 2026

(54) SYSTEMS AND METHODS FOR CONTROLLING A STARTUP SYSTEM OF A MARINE VESSEL

(71) Applicant: Brunswick Corporation, Mettawa, IL (US)

(72) Inventor: Eric T. Surma, Ormond Beach, FL (US)

(73) Assignee: Brunswick Corporation, Mettawa, IL (US)

( * ) Notice: Subject to any disclaimer, the term of this patent is extended or adjusted under 35 U.S.C. 154(b) by 226 days.

(21) Appl. No.: 18/502,709

(22) Filed: Nov. 6, 2023

(51) Int. Cl.
*B63J 2/02* (2006.01)
*B63B 79/40* (2020.01)
*B63J 3/04* (2006.01)

(52) U.S. Cl.
CPC ..... *B63B 79/40* (2020.01); *B63J 2/02* (2013.01); *B63J 3/04* (2013.01)

(58) Field of Classification Search
CPC ..... B63B 79/40; B63J 2/02; B63J 3/04
See application file for complete search history.

(56) References Cited

U.S. PATENT DOCUMENTS 5,787,832 A * 8/1998 Spinka ..... B63B 43/14 114/123
8,725,329 B1 5/2014 Snyder et al.
8,803,711 B1 * 8/2014 Gonring ..... H05B 47/155 340/987
9,802,688 B1 * 10/2017 Tuchscherer ..... B63H 20/10
10,191,490 B2 * 1/2019 Akuzawa ..... B63H 25/04
10,654,551 B1 * 5/2020 Doremus ..... B63B 1/246
10,967,946 B1 * 4/2021 Tuchscherer ..... B63H 20/10
11,046,410 B2 6/2021 Gonring
11,250,653 B2 2/2022 Gonring et al.
11,600,184 B2 * 3/2023 Derginer ..... B63B 79/40
11,702,178 B2 * 7/2023 Dannenberg ..... B63H 21/21 701/21
11,702,179 B2 7/2023 Gonring
12,263,921 B1 * 4/2025 Pienta ..... B63B 1/32
12,371,140 B1 * 7/2025 Dannenberg ..... B63H 25/04
2012/0277941 A1 * 11/2012 Noffsinger ..... G08G 3/00 701/21
2019/0155287 A1 * 5/2019 Arbuckle ..... G08G 3/02
2020/0255104 A1 * 8/2020 Gonring ..... B63H 21/21
2020/0393259 A1 * 12/2020 Gantt, Jr. ..... B60L 53/65
(Continued)

OTHER PUBLICATIONS

Lana et al, Methodology of Power Distribution System Design for Hybrid Short Sea Shipping, 2019, IEEE, p. 9591-9600 (Year: 200).*
(Continued)

*Primary Examiner* — Mcdieunel Marc
(74) *Attorney, Agent, or Firm* — Andrus Intellectual Property Law, LLP

(57) ABSTRACT

A startup system for a marine vessel is provided. The startup system includes at least one marine vessel accessory system configured to perform a startup procedure having a startup duration while the marine vessel is docked at a docking location. The startup system further includes a control system configured to receive a departure time for the marine vessel, determine a startup time based on the startup duration and the departure time, and control the at least one marine vessel accessory system to perform the startup procedure at the startup time.

20 Claims, 4 Drawing Sheets

(56) References Cited

U.S. PATENT DOCUMENTS

2021/0221485 A1* 7/2021 Grunewald Mayer ..... B63B 79/40
2022/0063526 A1 3/2022 Ledden et al.

OTHER PUBLICATIONS

Moulton et al., An Autonomous Surface Vehicle for Long Term Operations, 2018, IEEE, p. 1-10 (Year: 2018).*
Matuszak et al., Results of load's observation for selected marine electric power plants systems in floating objects, 2015, IEEE, p. 1-6 (Year: 2015).*
Watts, The SRB Retrieval Support Craft, 1979, IEEE, p. 691-694 (Year: 1979).*
Ford, The Electrically Driven Gyroscope in Marine Work, 1914, IEEE, p. 1-21 (Year: 1914).*
Moroney, Jr., et al., An Interactive System for Precise Buoy Deployment and Position Assurance, 1996, IEEE, p. 584-589 (Year: 1996).*
Morgere et al., Electronic Navigational Chart Generator for a Marine Mobile Augmented Reality System, 2014, IEEE, p. 1-9 (Year: 2014).*

* cited by examiner

SYSTEMS AND METHODS FOR CONTROLLING A STARTUP SYSTEM OF A MARINE VESSEL

FIELD

The present disclosure generally relates to control systems for a marine vessel, and more particularly to startup systems and methods that control startup of various marine vessel accessory systems based on an anticipated departure time of the marine vessel.

BACKGROUND

The following U.S. Patents and Patent Publications provide background information and are incorporated herein by reference, in entirety:

U.S. Pat. No. 8,725,329 is directed to systems and methods for controlling a hybrid propulsion system for a marine vessel. A control circuit controls an electric motor-generator according to at least two modes, including a first mode wherein the electric motor-generator receives power from a battery and rotates a driveshaft to drive a propulsor and a second mode wherein the electric motor-generator generates power to charge the battery based upon torque from an internal combustion engine. A time criteria and at least one user-desired operational characteristic of at least one of the internal combustion engine, electric motor-generator, and battery are input to the control circuit. Based on the time criteria and user-desired operational characteristic, the control circuit calculates a schedule for at least one of charging the battery with the electric motor-generator and discharging the battery to a house load of the marine vessel. The control circuit further controls operation of the electric motor-generator according to the schedule.

U.S. Pat. No. 11,046,410 is directed to a remote control system for a marine vessel includes at least one fob communicating with a helm transceiver module on the vessel. The fob has at least two user inputs, each associated with a different user-selectable fob command, wherein the fob is configured to wirelessly transmit a fob identification and a selected fob command in response to user selection of a user input. The helm transceiver module is configured to store unique fob identifications for permitted fobs and a set of system commands for each user-selectable fob command for each fob identification, wherein the set of system commands are configurable by a user. Upon receipt of the fob identification and the selected fob command, the helm transceiver module verifies that the fob identification is associated with one of the permitted fobs and identifies the user-configured set of system commands associated with the selected fob command and the fob identification. The helm transceiver module then communicates instructions via a vessel network based on the set of system commands to activate or deactivate devices on the marine vessel.

U.S. Pat. No. 11,250,653 is directed to a remote control system for a marine vessel that includes a helm transceiver positioned on the marine vessel and configured to communicate with one or more fobs, and at least one operator fob configured to wirelessly transmit a fob signal to the helm transceiver on the marine vessel. A controller is configured to receive the fob signal transmitted by the operator fob and to determine an operator distance based on the fob signal. The operator distance is compared with one or more threshold distances, and then a system command is generated based on the comparison of the operator distance to the one or more threshold distances so as to control operation of one or more devices on the marine vessel.

U.S. Pat. No. 11,702,179 is directed to a remote control system for a marine vessel that includes at least one fob and a configuration control system configured to detect available devices on the marine vessel to be controlled remotely for the marine vessel, generate a list of available functions for at least one user-selectable fob command based on the detected available devices, present the list of available functions to the user via a fob configuration user interface such that the user can select one or more functions in the list of available functions, identify a system command associated with each selected function so as to configure a set of system commands based on the user-selected functions, and store the user-configured set of system commands in association with the fob identification and the selected fob command. The system further includes a helm transceiver module to effectuate activation/deactivation of the available devices based on the user-configured set of system commands.

U.S. Patent Publication No. 2022/0063526 is directed to a method for automatically reducing the power consumed by devices from a power source having a limited amount of power. The method includes determining with a control system which of the devices is consuming the power. The method further includes identifying a candidate device among the devices to tentatively control to reduce the power consumed by the candidate device. The method further includes accessing a power control model, where the power control model includes pairings of the candidate device with complementary devices among the devices, and where the devices in each of the pairings consume the power in a related pattern. The method further includes controlling the candidate device to reduce the power consumed thereby only when each of the complementary devices in each of the pairings in the power control model are determined to be in a non-power consuming state.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one implementation of the present disclosure, a startup system for a marine vessel is provided. The system includes at least one marine vessel accessory system configured to perform a startup procedure having a startup duration while the marine vessel is docked at a docking location and a control system. The control system is configured to receive a departure time for the marine vessel, determine a startup time based on the startup duration and the departure time, and control the at least one marine vessel accessory system to perform the startup procedure at the startup time.

According to another implementation of the present disclosure, a method for operating a startup system for a marine vessel having at least one marine vessel accessory system is provided. The at least one marine vessel accessory system is configured to perform a startup procedure having a startup duration while the marine vessel is docked at a docking location. The method includes receiving a departure time for the marine vessel, determining a startup time based on the startup duration and the departure time, and controlling the at least one marine vessel accessory system to perform the startup procedure at the startup time.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 1:
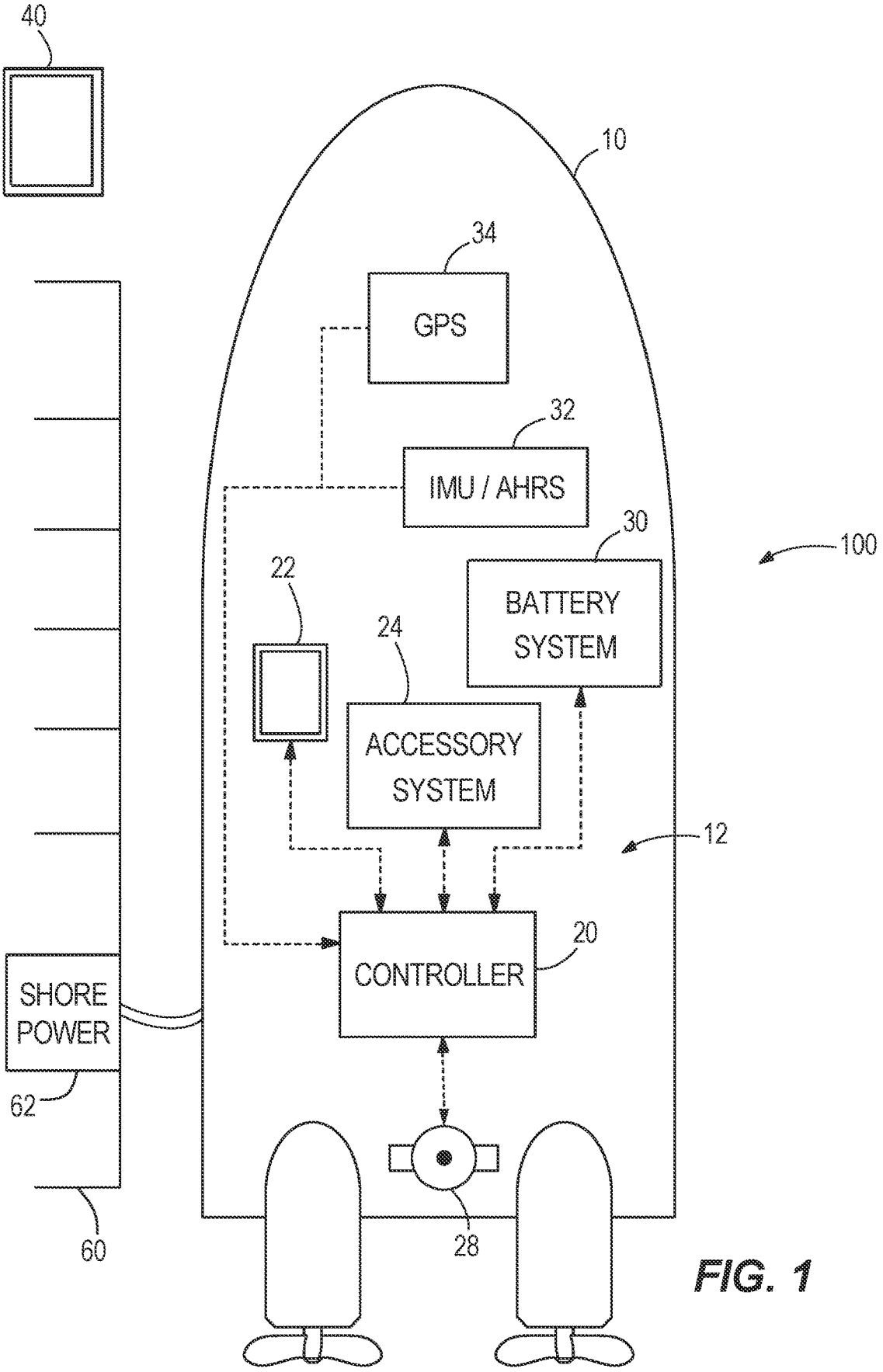
FIG. 1 is a schematic diagram of a marine vessel having a startup system according to an exemplary embodiment of the present disclosure.

Certain accessory systems on marine vessels take a significant amount of time to start up and reach an operational state, which can be frustrating and decrease functionality and/or enjoyment of the marine vessel for its occupants. For example, refrigeration units may require two hours or more to cool to a temperature that is safe to store food, and gyroscopic stabilization units that dampen pitch and roll movements of the vessel may require 25-35 minutes or more for the flywheel that generates the counteracting torque to reach typical operational speed of 20,000-100,000 RPM. Such systems also require a significant amount of power to complete their respective startup procedures, and therefore it is most efficient to complete the startup procedures when the vessel is docked and connected to a shore power source, rather than drawing power from a generator or alternator located on the vessel. Accordingly, using existing systems and methods, operators must either arrive at the docking location far in advance of an intended departure time to manually initiate startup of the various accessory systems, forego operation of such systems, or inefficiently utilize on-board power sources to operate the systems, with the extended startup times ensuring that the accessory systems are only fully operational for only a portion the trip.

The present inventors have therefore recognized that a startup system for a marine vessel that permits an operator to initiate a startup procedure remotely or automatically for multiple accessory systems having time-consuming startup procedures would be useful. The present invention provides systems and methods in which accessory startup can be automatically controlled by the vessel control system based on an anticipated departure time. In one embodiment, an operator can select an intended departure time, and/or may select one or more of the vessel accessory systems for startup. Such input can be provided from an operator's mobile device so that the operator need not be physically present at the marina where the vessel is docked. In other embodiments, the operator's selection of accessory systems for startup and the departure time may be scheduled in advance via the operator's mobile device or at a helm display device. In still further embodiments, the control system is configured to automatically select the vessel accessory systems for startup based on various conditions (e.g., weather conditions, water conditions), or a predetermined set of vessel accessory systems may always be designated for startup. Based on the accessory systems to be started and the departure time, the startup system determines whether the power available to the vessel is sufficient and prioritizes startup of the selected systems accordingly. For example, if the operator has selected both a refrigeration unit and a gyroscopic stabilization unit for startup and a departure time of noon, the startup system will automatically prioritize startup of the systems and control the refrigeration unit to begin startup at noon, and the gyroscopic stabilization unit to begin startup at 11:30. In this way, an operator can easily ensure that the vessel is comfortable for occupants upon arrival at the docking location. At the same time, fuel efficiency of the vessel is maximized.

FIG. 1 depicts a marine vessel 10 having a startup system 100 according to an exemplary implementation of the present disclosure. The startup system 100 includes a control system 12 having a controller 20 that controls startup of one or more accessory systems 24 responsive to input from an operator and responsive to determinations by the controller 20 that certain criteria are met. Examples of accessory systems 24 having startup controlled by the controller 20 include, but are not limited to, refrigeration units, climate control/HVAC units, and air conditioning units. Each accessory system 24 may require an extended startup period (e.g., more than 20 minutes) to reach a fully operational state (e.g., achievement of a targeted temperature of a refrigeration unit suitable for storing food, achievement of a targeted ambient temperature within a climate-controlled cabin). In further embodiments, the accessory system 24 could include an electronic device that requires an extended period of time to download data, for example, weather or geographic data for a navigation device, or other over-the-air updates. In still further embodiments, the accessory system 24 could be a heater for a battery system (e.g., rechargeable battery system 30, described in further detail below). For vessels operating in cold weather environments, the range of the battery system may be increased by operating the heater to increase the battery system temperature during a controlled startup while the vessel is docked.

The marine vessel 10 may further include a gyroscopic stabilizer 28. Gyroscopic stabilizer 28 may be utilized to suppress unwanted pitch and/or roll disruptions to the orientation of the marine vessel 10 due to the forces of waves, wakes, or wind acting upon the marine vessel 10 by producing a stabilizing torque through controlled precession of stored angular momentum of a spinning flywheel. As noted above, the flywheel must reach a high rate of spin (e.g., 20,000- 100,000 RPM or more) to produce such stabilizing torques, and accordingly, marine gyroscopic stabilizers often require at least 25 minutes of startup time to achieve such rates of spin, with larger flywheels capable of providing larger stabilizing torques requiring more startup time. In some embodiments, the controller 20 may further communicate with an inertial measurement unit (IMU) and/or attitude heading reference system (AHRS) 32 and global positioning system (GPS) 34. As described in further detail below, the IMU/AHRS 32 may include an accelerometer configured to sense the motion of the vessel 10 and the GPS 34 may provide a global position of the vessel 10. Such information may be utilized by the controller 20 to determine whether weather conditions in the intended travel path of the vessel 10 warrant startup of the gyroscopic stabilizer 28.

In some embodiments, the marine vessel 10 includes a rechargeable battery system 30. The battery system 30 may store energy to power a propulsion system of the marine vessel 10, as well as one or more of the vessel accessory systems 24, and/or the gyroscopic stabilizer 28. In an exemplary embodiment, the battery system 30 includes one or more batteries or banks of batteries. For example, system 30 may include one or more lithium-ion (LI) battery systems, each LI battery comprised of multiple battery cells. In other embodiments, system 30 may include one or more fuel cells, flow batteries, ultracapacitors, and/or other devices capable of storing and outputting electric energy.

The controller 20 may be further configured to receive operator input from a helm display device 22, and/or a mobile device 40 (e.g., a cell phone, a tablet computer) that can be located remotely from the marine vessel 10 and/or the docking structure 60. In various embodiments, one or both of the display device 22 and the mobile device 40 may be, for example, part of an onboard management system, such as the VesselView™ by Mercury Marine of Fond du Lac, Wis. Specifically, one or both of the display device 22 and the mobile device 40 may be configured to provide an operator the ability to input selected accessory systems for startup and to input an intended departure time. In some instances, the input device will include a calendar function that permits scheduling of multiple departures. For example, the operator could provide inputs indicating a desire to startup a refrigeration unit and a gyroscopic stabilizer every Saturday at noon for the month of July. In some embodiments, the operator's preferences regarding selected accessory systems and departure times may be stored and presented to the operator upon subsequent use such that the operator does not need to manually re-enter such inputs.

The marine vessel 10 is shown to be docked at a docking structure 60 with a shore power source 62 for providing power to the marine vessel 10. The particular type of shore power source can vary and in the example shown the shore power source 62 is a standard utility power source that provides power from a utility to the marine vessel 10 via a wired connection. The controller 20 may be configured to control the power supplied from the shore power source 62 and/or the battery system 30 for startup of the accessory systems using a digital switching system configured to control power to the various systems such as a CZone Control and Monitoring system by Power Products, LLC of Menomonee Falls, Wis. Other examples of power control arrangements are further exemplified and described at U.S. application Ser. Nos. 17/009,412 and 16/923,866, which are each incorporated herein by reference in its entirety.

Figure 2:
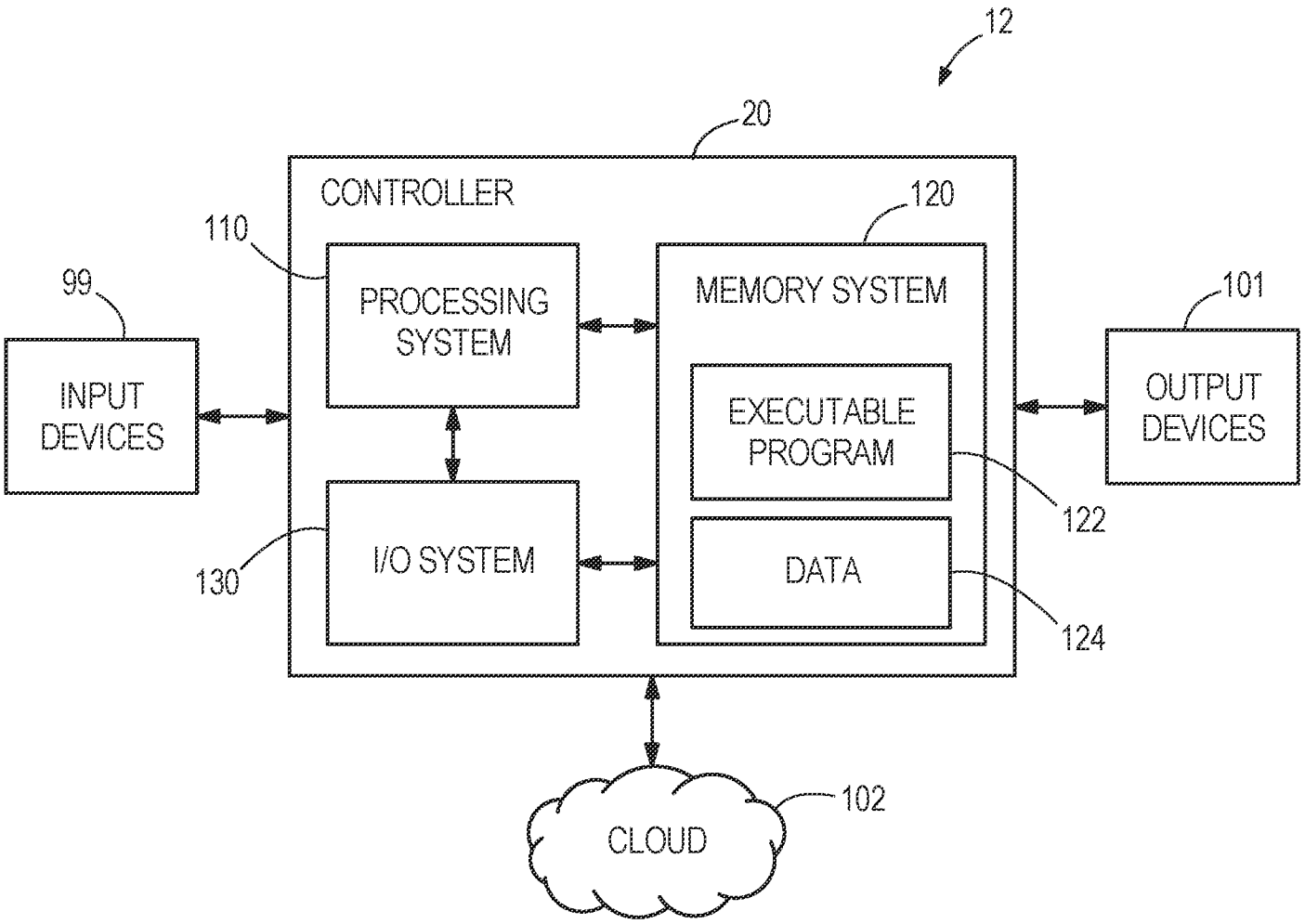
FIG. 2 is a schematic diagram of an exemplary controller that may be incorporated within the startup system of the marine vessel of FIG. 1.

Further details of the control system 12 are depicted in FIG. 2. The control system 12 includes all control elements necessary to effectuate the methods of the present disclosure, including the controller 20, the power management system (e.g., CZone), battery controllers, and accessory system controllers. Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

In certain examples, the controller 20 communicates with each of the one or more components of the startup system via a communication link CL, which can be any wired or wireless link. The controller 20 is capable of receiving information and/or controlling one or more operational characteristics of the startup system and its various subsystems by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components in the system. Moreover, the communication link CL lines are meant only to demonstrate that the various control elements are capable of communicating with one another, and do not represent actual wiring connections between the various elements, nor do they represent the only paths of communication between the elements. Additionally, the controller 20 of the startup system 100 may incorporate various types of communication devices and systems, and thus the illustrated communication links CL may in fact represent various different types of wireless and/or wired data communication systems.

The controller 20 may be a computing system that includes a processing system 110, memory system 120, and input/output (I/O) system 130 for communicating with other devices, such as input devices 99 (e.g., helm display 22, IMU/AHRS 32, GPS 34, mobile device 40) and output devices 101 (e.g., accessory system 24, gyroscopic stabilizer 28) either of which may also or alternatively be stored in a cloud 102. The processing system 110 loads and executes an executable program 122 (e.g., a startup system prioritization program) from the memory system 120, accesses data 124 stored within the memory system 120 (e.g., an operator's preferred inputs, system startup times), and directs the startup system 100 to operate as described in further detail below.

The processing system 110 may be implemented as a single microprocessor or other circuitry, or be distributed across multiple processing devices or sub-systems that cooperate to execute the executable program 122 from the memory system 120. Non-limiting examples of the processing system include general purpose central processing units, application specific processors, and logic devices. The memory system 120 may comprise any storage media readable by the processing system 110 and capable of storing the executable program 122 and/or data 124. The memory system 120 may be implemented as a single storage device, or be distributed across multiple storage devices or subsystems that cooperate to store computer readable instructions, data structures, program modules, or other data. The memory system 120 may include volatile and/or non-volatile systems, and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

Figure 3:
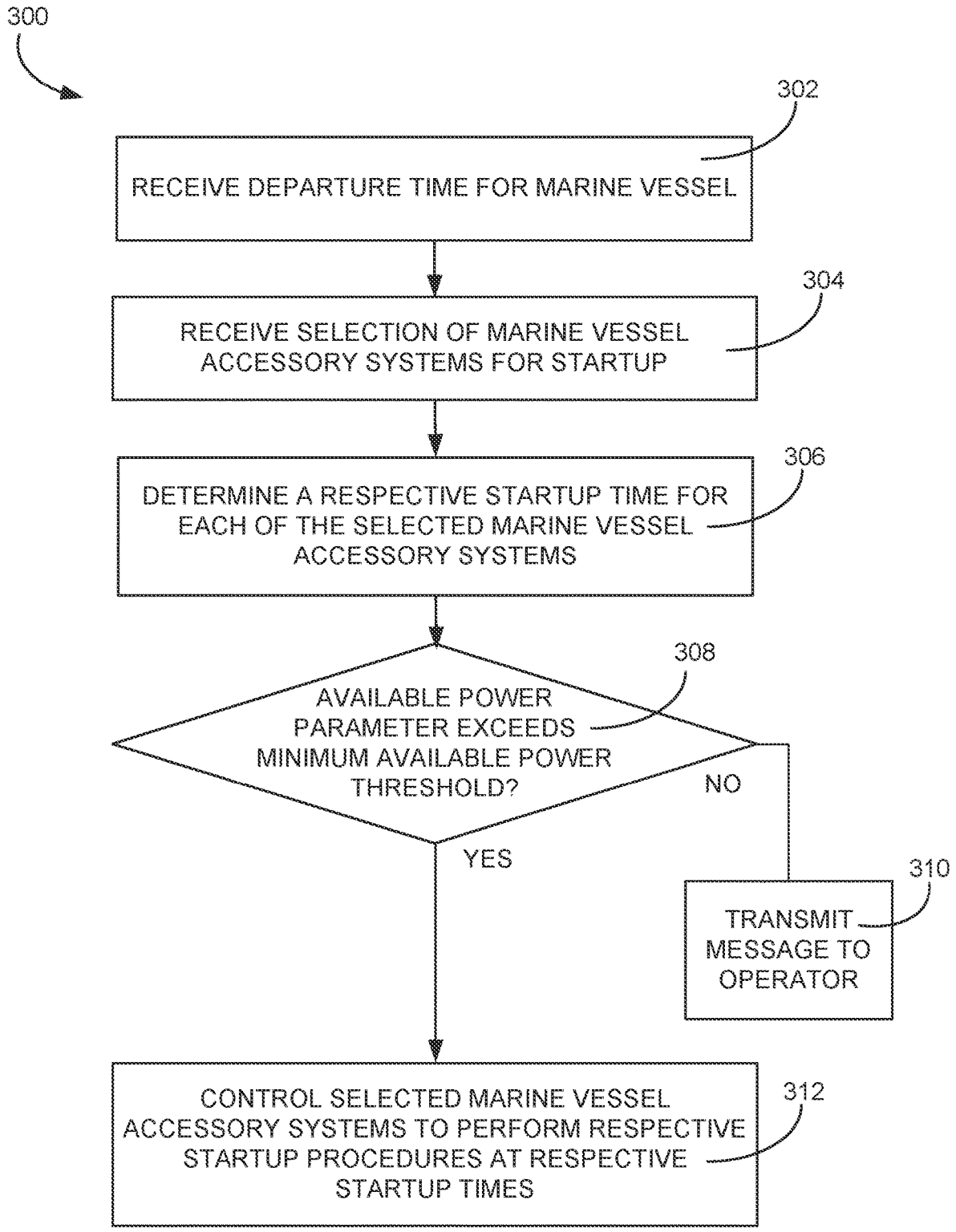
FIGS. 3 and 4 are flow charts of exemplary methods for controlling the startup system of FIG. 1.

Turning now to FIG. 3, a flow chart of a method 300 for controlling the startup system 100 of the marine vessel 10 is provided. In an exemplary implementation, the method is performed predominantly by controller 20 of the control system 12 while the marine vessel 10 is stationary. For example, the marine vessel 10 may be docked at a docking structure 60 and connected to shore power 62.

Method 300 commences at step 302, in which the controller 20 receives a departure time for the marine vessel 10. In some embodiments, the operator may enter a departure time via mobile device 40 or helm display 22 on the same day of the intended departure. For example, the operator may transmit an intended departure time of noon from the operator's mobile device 40 on the morning of the day of departure, before the operator has arrived at the marina where the marine vessel 10 is docked. In other embodiments, the operator may preemptively schedule one or more departure times via a calendar application displayed on the mobile device 40 or helm display 22. For example, the operator may schedule intended departures at noon every Saturday in a given month. Such departures may be stored in the memory system 120 of the controller 20 such that the controller automatically retrieves such scheduled departures and begins to execute the startup procedure every Saturday for that month without further input required from the operator.

At step 304, the controller 20 receives a selection of one or more of the marine vessel accessory systems for startup. As described above, the accessory systems on the marine vessel 10 available to perform a startup procedure according to method 300 may include, but are not limited to, an air conditioning unit, a climate control/HVAC unit, a refrigeration unit, and a gyroscopic stabilization unit. In some embodiments, an operator may manually select the accessory systems for startup (e.g., via mobile device 40 or helm user interface device 22) and the selection may be transmitted to the controller 20 along with the departure time. In other embodiments, the controller 20 and/or the mobile device 40 may be configured to store the operator's preferred selection and either retrieve or transmit the preferred selection for every startup procedure unless the operator takes steps to modify the preferred selection.

At step 306, the controller 20 determines a respective startup time for each of the selected accessory systems. In some embodiments, the length of the startup time may be stored in the memory system 120 of the controller 120 and generally unchanging regardless of the current conditions of the vessel 10. In other embodiments, the length of the startup time may depend on further operator input, the current conditions of the vessel 10 (e.g., current ambient temperature of the cabin or a refrigeration unit), and/or data 124 stored in the memory system 120 of the controller 20 or retrieved from the cloud 102 (e.g., a forecasted temperature). For example, an operator selection to startup an air conditioning unit may include a request to cool a cabin to 72° F. Based on sensor data indicating the current ambient temperature of the cabin and stored data indicating the size of the cabin, the controller 20 may be configured to determine the time in which the air conditioning unit must be started in order to cool the cabin to 72° F. by the selected departure time.

At step 308, the controller 20 determines whether an available power parameter for the vessel 10 exceeds a minimum available power threshold. For example, if the vessel 10 is connected to the shore power source 62, the controller 20 may be configured to determine a current level of the shore power source 62 and to determine whether the current level exceeds a cumulative minimum current level threshold for the selected accessory systems. As another example, if the vessel 10 is utilizing the battery system 30 to provide startup power, the controller 20 may be configured to determine a state of charge (SOC) level of the battery system 30 and to determine whether the SOC level exceeds a minimum current level threshold.

If the controller 20 determines at step 308 that the available power parameter does not exceed the minimum available power threshold, method 300 proceeds to step 310 and concludes as the controller 20 transmits a message to the operator indicating an inability to perform the startup procedure. For example, if the controller 20 determines that the marine vessel 10 is not connected to shore power 62 and the SOC level of the battery system 30 is insufficient to perform startup for each of the selected marine vessel accessory systems, the message transmitted to the operator may prompt an action to connect the marine vessel 10 to shore power 62, or to remove certain accessory systems from the selected subset for startup. For example, if the available power does not meet the minimum threshold, the operator may opt to remove an accessory system that requires a significant amount of power (e.g., a refrigeration unit) from the selected subset such that the startup procedure can proceed with the other selected marine vessel accessory systems.

If the controller 20 determines at step 308 that the available power parameter does not exceed the minimum available power threshold, method 300 proceeds to conclude at step 312 by controlling the selected marine vessel accessory systems to perform their respective startup procedures at the respective startup times determined at step 306. For example, if the operator has selected startup of a climate control system that will require one hour of startup time and a gyroscopic stabilizer that will require 30 minutes of startup time, and the shore power source 62 cannot supply enough power to startup both systems simultaneously, the controller 20 may control the climate control system to initiate its startup procedure 1.5 hours before the departure time and the stabilizer to initiate its startup procedure 30 minutes before the departure time, because the initiating startup of the stabilizer first would require more power to maintain the flywheel at operational speed for one hour than maintaining the climate control at its targeted temperature for a half hour.

Figure 4:
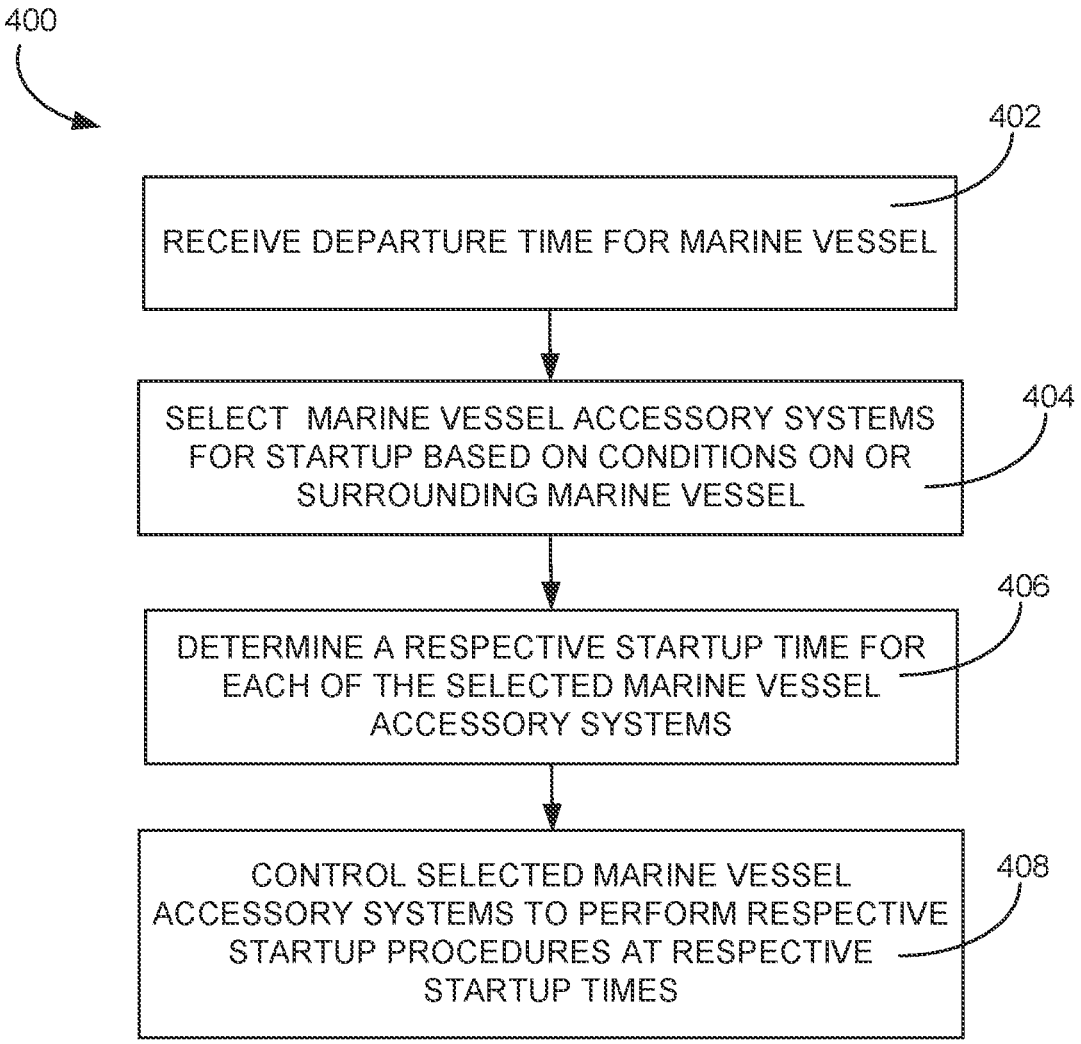

FIG. 4 depicts a flow chart of another method 400 for controlling the startup system 100 of the marine vessel 10. In contrast to method 300 depicted in FIG. 3, the method 400 depicts an embodiment in which the controller 20 automatically determines the vessel accessory systems included in the startup procedure, rather than responding to an operator selection of vessel accessory systems for startup.

Method 400 begins with step 402 in which the controller 20 receives a departure time for the marine vessel 10. As described above, in some embodiments, the operator may enter a departure time via mobile device 40 or helm display 22 on the same day of the intended departure. In other embodiments, the operator may preemptively schedule one or more departure times via a calendar application displayed on the mobile device 40 or helm display 22.

At step 404, the controller 20 determines the vessel accessory systems for startup based on conditions on or surrounding the marine vessel 10. To make this determination, the controller 20 may retrieve a predetermined selection of accessory devices, or it may utilize other data sources and/or devices and systems of the marine vessel 10 to make the selection. For example, the controller 20 may utilize accelerometer data from the IMU/AHRS 32 to determine whether pitch and/or roll movements experienced by the vessel 10 while docked indicate a need to start up the stabilizer 28. If the magnitude of the movements do not exceed a specified threshold, or if forecasted weather data (e.g., storm indications, wind speed, etc. retrieved from cloud 102) indicates that water in the intended travel path of the vessel 10 is unlikely to be choppy, the controller 20 may not select the stabilizer 28 in the group of accessory systems to include in the startup procedure. In such cases, the controller 20 may also transmit a message to the operator noting that the stabilizer 28 has not been selected for startup because the water conditions are forecasted to be calm.

In further examples, the controller 20 may utilize temperature sensor measurements and the time/date/location of the departure in order to determine whether certain vessel accessory systems should be selected for startup. For example, if the marine vessel 10 is located in the Midwest, the controller 20 may utilize the month of departure when determining whether a heating system for a climate-controlled cabin should be selected for the startup procedure. If the scheduled departure is in July, the controller 20 may automatically deselect the heating system for inclusion in the startup procedure for any departure time. By contrast, if the scheduled departure is in October, the controller 20 may utilize current ambient temperature measurements and/or forecasted temperatures when determining whether a heating system should be selected for inclusion in the startup procedure.

At step 406, the controller 20 determines a respective startup time for each of the selected accessory systems. As described above, in various embodiments, the length of the startup procedure for each of the selected accessory systems may be fixed or may depend on vessel conditions (e.g., current refrigeration unit temperature, current ambient temperature). Method 400 then proceeds to conclude at step 408 by controlling the selected marine vessel accessory systems to perform their respective startup procedures at the respective startup times determined at step 406.

This written description uses examples to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

I claim:

1. A startup system for a marine vessel comprising:

at least one marine vessel accessory system configured to perform a startup procedure having a startup duration while the marine vessel is docked at a docking location; and a control system configured to:

receive a departure time for the marine vessel;

determine a startup time based on the startup duration and the departure time; and control the at least one marine vessel accessory system to perform the startup procedure at the startup time.

2. The system of claim 1, wherein the at least one marine vessel accessory system comprises an air conditioning unit, an HVAC unit, a refrigeration unit, or a gyroscopic stabilization unit.

3. The system of claim 1, wherein the control system is further configured to:

determine whether an available power parameter exceeds a minimum available power threshold; and control the at least one marine vessel accessory system to perform the startup procedure at the startup time responsive to a determination that the available power parameter exceeds the minimum available power threshold.

4. The system of claim 3, wherein:

the marine vessel is coupled to a shore power source while the marine vessel is docked at the docking location;

the at least one marine vessel accessory system is configured to draw power from the shore power source to perform the startup procedure; and the available power parameter is a current level of the shore power source and the minimum available power threshold is a minimum current level threshold.

5. The system of claim 3, wherein:

the system further comprises at least one marine vessel battery;

the at least one marine vessel accessory system is configured to draw power from the at least one marine vessel battery to perform the startup procedure; and the available power parameter is a state of charge level of the at least one marine vessel battery and the minimum available power threshold is a minimum state of charge threshold.

6. The system of claim 1, wherein:

the at least one marine vessel accessory system comprises a plurality of marine vessel accessory systems; and the control system is further configured to:

receive an operator selection of a subset of the plurality of marine vessel accessory systems, each of the plurality of marine vessel accessory systems in the selected subset having a respective startup duration;

determine a respective startup time for each of the plurality of marine vessel accessory systems in the selected subset based on their respective startup durations and the departure time; and control the selected subset of the plurality of marine vessel accessory systems to perform their respective startup procedures at their respective startup times.

7. The system of claim 6, further comprising a mobile device configured to store the operator selection of the subset of the plurality of marine vessel accessory systems and transmit the departure time for the marine vessel.

8. The system of claim 1, wherein:

the at least one marine vessel accessory system comprises either an air conditioning unit or an HVAC unit; and the control system is configured to determine the startup duration for the air conditioning unit or the HVAC unit based on at least one of a size of the marine vessel, a current ambient temperature of the marine vessel, and a forecasted temperature from a weather report.

9. The system of claim 1, wherein:

the at least one marine vessel accessory system comprises a refrigeration unit; and the control system is configured to determine the startup duration for the refrigeration unit based on at least one of a current temperature of the refrigeration unit and a current ambient temperature of the marine vessel.

10. The system of claim 1, wherein:

the at least one marine vessel accessory system comprises a gyroscopic stabilization unit; and the control system is further configured to perform the startup procedure responsive to receipt of a weather report or a measurement from an accelerometer indicating a need to startup the gyroscopic stabilization unit.

11. A method for operating a startup system for a marine vessel having at least one marine vessel accessory system configured to perform a startup procedure having a startup duration while the marine vessel is docked at a docking location, the method comprising:

receiving a departure time for the marine vessel;

determining a startup time based on the startup duration and the departure time; and controlling the at least one marine vessel accessory system to perform the startup procedure at the startup time.

12. The method of claim 11, wherein the at least one marine vessel accessory system comprises an air conditioning unit, an HVAC unit, a refrigeration unit, or a gyroscopic stabilization unit.

13. The method of claim 1, wherein the method further comprises:

determining whether an available power parameter exceeds a minimum available power threshold; and controlling the at least one marine vessel accessory system to perform the startup procedure at the startup time responsive to a determination that the available power parameter exceeds the minimum available power threshold.

14. The method of claim 13, wherein:

the marine vessel is coupled to a shore power source while the marine vessel is docked at the docking location;

the at least one marine vessel accessory system is configured to draw power from the shore power source to perform the startup procedure; and the available power parameter is a current level of the shore power source and the minimum available power threshold is a minimum current level threshold.

15. The method of claim 13, wherein:

the system further comprises at least one marine vessel battery;

the at least one marine vessel accessory system is configured to draw power from the at least one marine vessel battery to perform the startup procedure; and the available power parameter is a state of charge level of the at least one marine vessel battery and the minimum available power threshold is a minimum state of charge threshold.

16. The method of claim 11, wherein:

the at least one marine vessel accessory system comprises a plurality of marine vessel accessory systems; and the method further comprises:

receiving an operator selection of a subset of the plurality of marine vessel accessory systems, each of the plurality of marine vessel accessory systems in the selected subset having a respective startup duration;

determining a respective startup time for each of the plurality of marine vessel accessory systems in the selected subset based on their respective startup durations and the departure time; and controlling the selected subset of the plurality of marine vessel accessory systems to perform their respective startup procedures at their respective startup times.

17. The method of claim 16, further comprising:

storing the operator selection of the subset of the plurality of marine vessel accessory systems.

18. The method of claim 11, wherein:

the at least one marine vessel accessory system comprises either an air conditioning unit or an HVAC unit; and the method further comprises determining the startup duration for the air conditioning unit or the HVAC unit based on at least one of a size of the marine vessel, a current ambient temperature of the marine vessel, and a forecasted temperature from a weather report.

19. The method of claim 11, wherein:

the at least one marine vessel accessory system comprises a refrigeration unit; and the method further comprises determining the startup duration for the refrigeration unit based on at least one of a current temperature of the refrigeration unit and a current ambient temperature of the marine vessel.

20. The method of claim 11, wherein:

the at least one marine vessel accessory system comprises a gyroscopic stabilization unit; and the method further comprises performing the startup procedure responsive to receipt of a weather report or a measurement from an accelerometer indicating a need to startup the gyroscopic stabilization unit.

* * * * *